US006140658A

United States Patent [19]

Jarvinen

[11] Patent Number: 6,140,658

[45] Date of Patent: Oct. 31, 2000

[54] COMBUSTION HEATED HONEYCOMB MANTLE INFRARED RADIATION

[75] Inventor: Philip O. Jarvinen, Amherst, N.H.

[73] Assignee: Lockheed Martin Corporation, Bethesda, Md.

[21] Appl. No.: 05/333,233

[22] Filed: Feb. 16, 1973

[51] Int. Cl.[7] ..... G01J 1/00; F23D 14/12; F21K 5/00

[52] U.S. Cl. ..... 250/495.1; 362/257; 431/347; 431/363; 431/365

[58] Field of Search ..... 431/328, 100, 431/111, 112, 113, 348, 158, 363, 365, 347; 350/272; 367/257; 250/495.1

[56] References Cited

U.S. PATENT DOCUMENTS

| | | | |
|---|---|---|---|
| 2,287,246 | 6/1942 | Hess | 431/348 |
| 2,336,816 | 12/1943 | Thompson | 431/100 |
| 2,761,959 | 9/1956 | Kunins | 350/272 |
| 3,088,271 | 5/1963 | Smith | 431/5 |
| 3,291,189 | 12/1966 | Schade, Jr. | 431/328 |
| 3,324,924 | 6/1967 | Hailstone et al. | 431/328 |
| 3,364,914 | 1/1968 | Bryan | 431/328 |
| 3,516,772 | 6/1970 | Strauss | 431/158 |

*Primary Examiner*—Stephen C. Buczinski
*Attorney, Agent, or Firm*—David W. Gomes

[57] ABSTRACT

An infrared radiation source is provided by directing combustion gases through a honeycomb mantle along the axis of symmetry thereof. The honeycomb mantle is formed of individual tubes disposed at an angle to the axis of symmetry of the mantle and is closed at the end away from the combustion gas input. The mantle may contain a structure to divert the combustion gases therein to aid in uniform heating.

16 Claims, 3 Drawing Sheets

COMBUSTION HEATED HONEYCOMB MANTLE INFRARED RADIATION

BACKGROUND OF THE INVENTION

Prior to the present invention infrared radiation sources included cesium arc lamps, electrical heated resistance elements and combustion heated sources having walls which are substantially impervious to the combustion gases. For many applications, these prior art sources of infrared radiation are sufficient. Nevertheless, certain applications require a new structured source.

SUMMARY OF THE INVENTION

Accordingly, it is an object of this invention to provide a new and novel source of infrared radiation.

It is another object of this invention to provide a source of infrared radiation including a combustion heated honeycomb mantle.

It is a further object of this invention to provide a shaped beam of infrared radiation from a combustion heated honeycomb mantle in combination with a reflector.

Briefly, in one embodiment an infrared radiation source comprises a honeycomb mantle which is closed at one end and heated with combustion gases applied to the other end. The honeycomb mantle comprises thin walls of honeycomb material with the axis of the honeycomb holes arranged at an angle to the axis of symmetry of the mantle. A diverter is disposed on the closed end of the mantle to divert the combustion gases and, thus, provide uniform heating of the mantle.

BRIEF DESCRIPTION OF THE DRAWINGS

The above-mentioned and other features of this invention will become more apparent by reference to the following description taken in conjunction with the accompanying drawings, in which.

DESCRIPTION OF PREFERRED EMBODIMENTS

Figure 1:
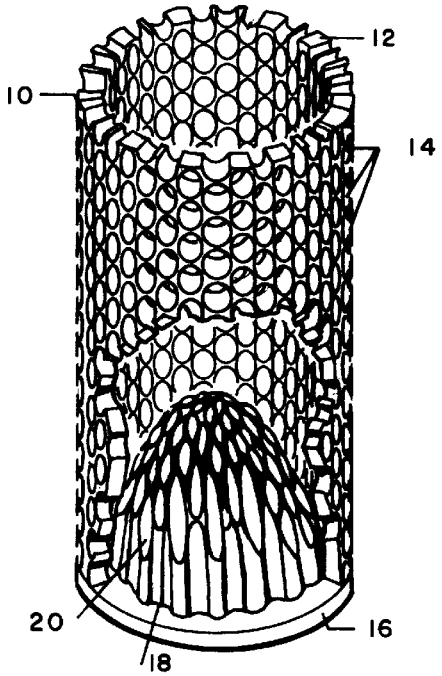
FIG. 1 is a perspective view of one embodiment of a honeycomb mantle.

Referring now to FIG. 1, there is illustrated thereby one embodiment of a honeycomb mantle 10 constituted according to the present invention. In this embodiment the honeycomb mantle 10 comprises a cylindrical structure 12 which is made up of individual tubes 14 on the order of 3/16 inches long. The holes in the tubes have a diameter on the order of 1/16 inches and there are approximately 70 tubes per square inch of surface area. It is desirable to make the tubes as short as possible to facilitate quick heating and produce higher temperatures. The tubes 14 have an axis perpendicular to the axis of symmetry of the structure 12. This is advantageous in that intrinsically a honeycomb structure will radiate most of its energy along the axis of the honeycomb holes and since the tubes 14 vary through 360° around the circumference of structure 12, radiation is obtained over 360° of azimuth. The structure can be fabricated of any suitable metal refractory selected for its temperature, structural and other characteristics. The tubes are preferably extruded silicon carbide. Silicon nitride can also be used as the honeycomb material as can hydrous aluminum silicate. However, while the silicon carbide can be heated to 1950° K, the hydrous aluminum silicate should be limited to a temperature on the order of 1800° K. Structure 12 is made of tubes of a slurry of refractory material containing a binder. The tubes are layed one on another and then fired.

The top of the structure 12 is open to permit combustion gases to be applied thereto. The combustion gases flow out the holes in the tubes 14. The bottom of the structure is closed by a plug 16. Plug 16 is preferably 2 made of alumina, however, other materials, for example, mullite, an aluminum oxide and magnesium oxide composition, can be used. Plug 16 is cemented to the bottom of the structure 12 using a suitable cement, for example, a water glass. A suitably shaped diverter 18 is disposed on top of plug 16.

The diverter is preferably also honeycombed so that it will heat quickly and efficiently. However, in the embodiment shown the tubes 20 constituting the honeycomb structure run parallel to the axis of symmetry of the pipe 12. The diverter is also preferably made of alumina. The purpose of the diverter is to divert or direct the combustion gases so that substantially uniform heating of the honeycomb pipe is achieved. Otherwise, the bottom of the honeycomb pipe nearest plug 16 would get hotter than the top portion thereof providing a nonuniform radiation output. The diverter changes the flow pattern of the combustion gases and also is heated by the gases to provide some of the output radiation from the mantle. The diverter 18 and plug 16 can be made integral and the holes filled at the bottom with a suitable cement, for example, an alumina cement. The diverter is not requierd in all applications.

Figure 2:
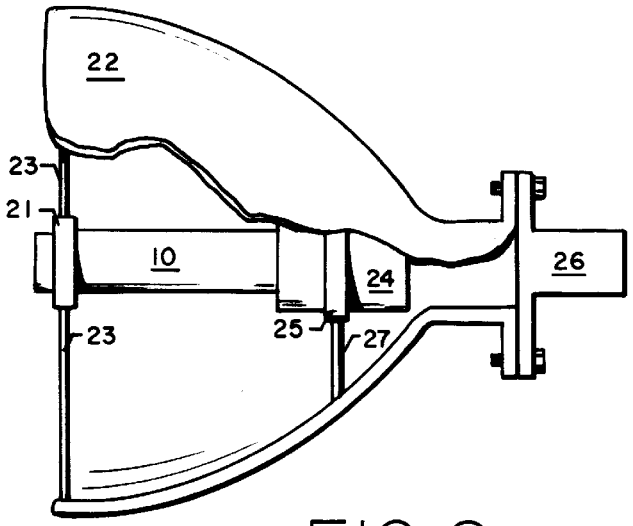
FIG. 2 is a plan view with a cut away portion of a shaped beam radiator employing the honeycomb mantle of FIG. 1.

The mantle is particularly useful in combination with a reflector to provide a relatively narrow shaped beam of radiant energy. One such combination is illustrated in FIG. 2, and comprises a honeycomb mantle 10 as described above disposed on axis within a reflector 22. Mantle 10 is mounted in the reflector using a spider arrangement comprising a ring 21 and arms 23. Reflector 22 can be parabolic, elliptical, spherical, or other shape, depending upon the desired beam shaping. Reflector 22 may be coated with a highly reflective material such as gold or other suitable reflective coating which can withstand the high temperatures. The holes of the mantle can be arranged at some other angle than 90° with respect to the axis of symmetry of the mantle and the center line of the reflector in order to change the radiated beam shape.

Positioned at the rear of mantle 10 is a combustor 24 for supplying combustion gases to the mantle. Combustor 24 is also disposed in the reflector with a spider arrangement including a ring 25 and arms 27. A fan 26, not shown in detail, is disposed to the rear of combustor 24 for supplying air to burn the fuel. Fan 26 also aids in keeping combustion products away from the reflector 22. Air flow is from right to left.

A protective transparent sheath (not shown) can be arranged about the honeycomb mantle 10. Preferably, the protective sheath is made of Lucalox (trademark General Electric Company) or Vistal (trademark Coors Porcelain Company), a high density, high purity aluminum oxide. The protective sheath can also be made of, for example, sapphire, magnesia spinel or quartz. The protective pipe prevents combustion products from impinging on reflector 22 and damaging the reflective properties thereof by covering or burning-off any coating thereon. However, in this instance, the position of the combustor and mantle would be reversed to permit combustion products to be exhausted out the neck of the reflector and the air flow would be from left to right. The sheath may be made of a material or appropriately coated to filter visible radiation or pass only radiation in a desired band.

Figure 3:
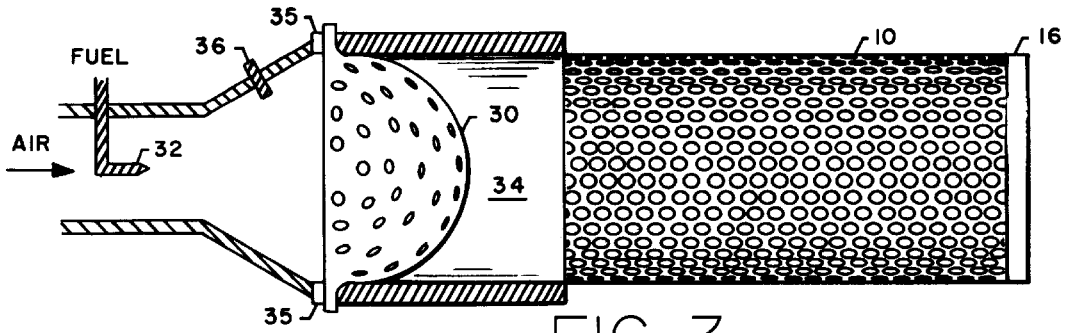
FIG. 3 is a plan view and partial section of a portion of the shaped beam radiator of FIG. 2.

Combustor 24 is illustrated in greater detail in FIG. 3 and comprises an aft facing flame holder 30 into which fuel is applied from a nozzle 32 and mixed with an oxidizer such as air. A combustion chamber 34 separates the flame holder 30 and mantle 10. Most of the burning takes place in the combustion chamber. An electrical igniter 36 is used to ignite the fuel mixture. The flame holder forms a recirculating pattern of flame downstream thereof.

The flame holder is attached to the combustion chamber by screws 35 and the mantle is cemented to the combustion chamber using suitable cement such as a water glass.

Figure 4:
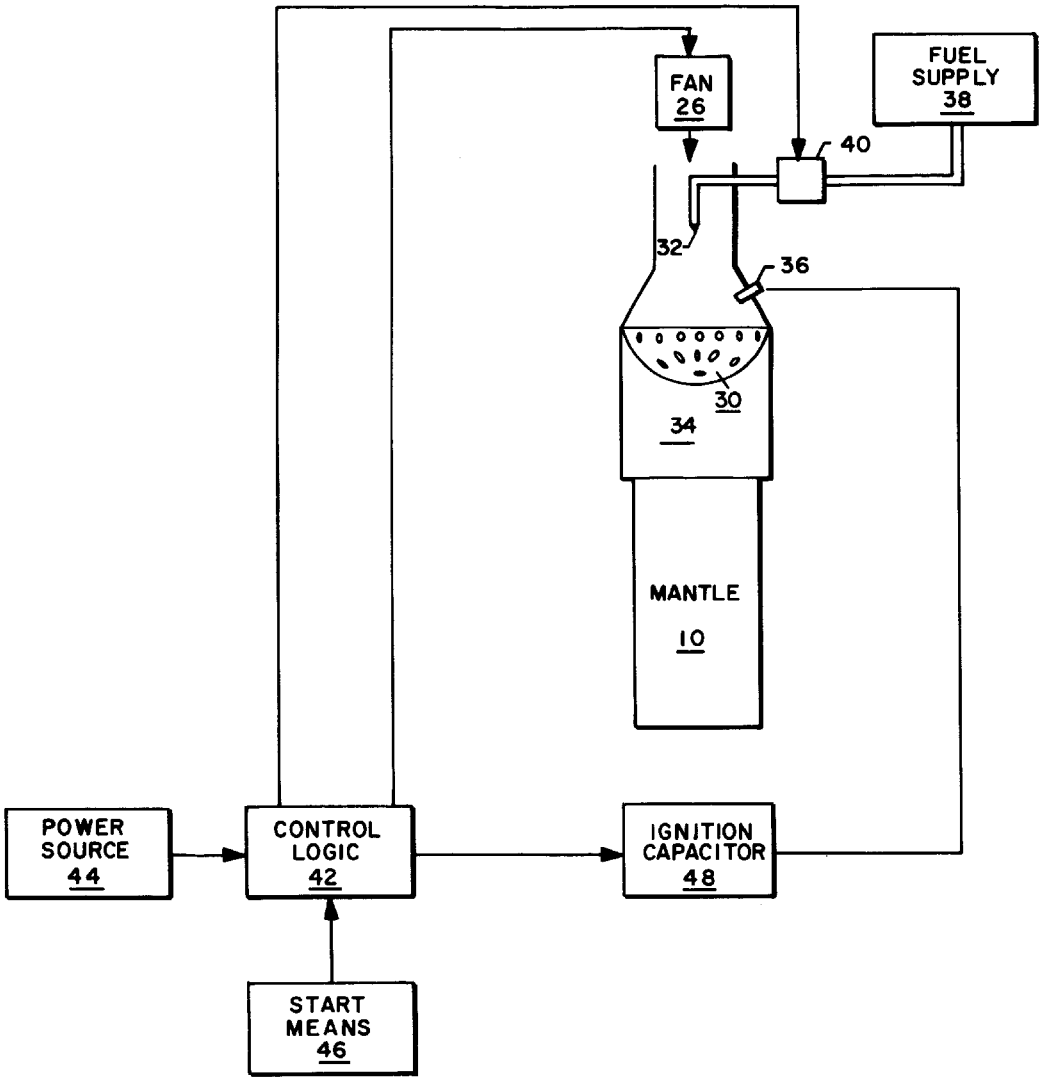
FIG. 4 is a schematic block diagram of a combustion heated honeycomb mantle infrared radiation source incorporating the apparatus of the present invention.

Turning now to FIG. 4, there is illustrated in schematic block form a complete combustion heated honeycomb mantle infrared radiation source in accordance with the principles of the present invention. The radiating honeycomb mantle 10 receives combustion gases from a combustion chamber 34 which is coupled via a flame holder 30 to air and fuel supplies 26 and 38, respectively. The fuel supply is coupled to nozzle 32 with a solenoid valve 40. An oxygen supply such as a tank of liquid oxygen could be used in place of fan 26 to supply the oxidizer, and a second solenoid to control oxygen flow would be provided.

Combustion of the fuel heats the mantle 10 which radiates the infrared.

An ignition spark gap 36 is coupled via control logic 42 to a power source 44. The control logic 42 receives as an input thereto a signal from the starting means 46. In operation an initial starting signal applied from the starting means 46 to the control logic 44 serves to apply power from source 44 to initiate the ignition sequence. This sequence includes charging of an ignition capacitor 48, opening the solenoid Valve 40 and operating fan 26. Once the ignition capacitor 48 is fully charged, it is discharged across the spark gap 36 to begin burning.

Figure 5:
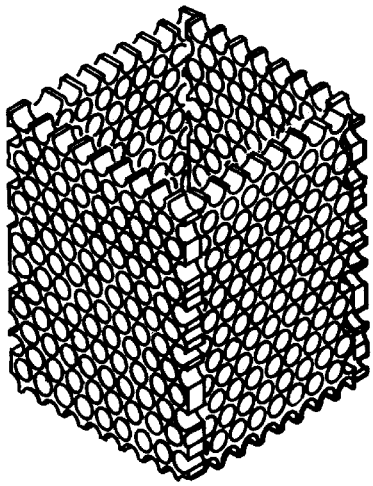
FIG. 5 is a perspective view of a rectangular shaped honeycomb mantle.
Figure 6:
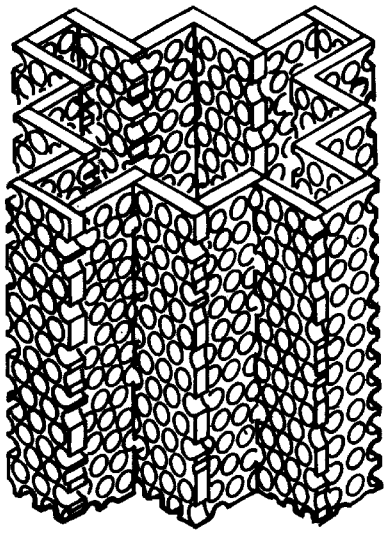
FIG. 6 is a perspective view of a many sided honeycomb mantle.
Figure 7:
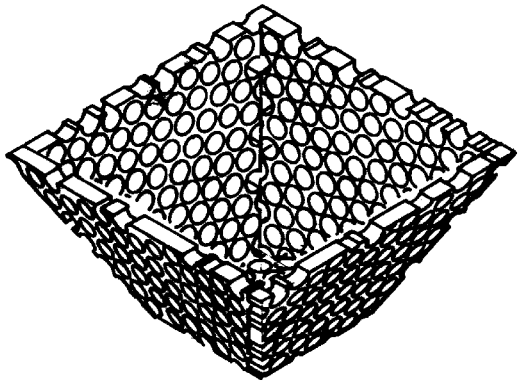
FIG. 7 is a perspective view of a converging honeycomb mantle.

Of course, the system described above could be accomplished by manual operation. Referring now to FIGS. 5, 6 and 7, there is illustrated thereby three different shaped honeycomb mantles which may be employed in the present invention. Other shapes can be used depending upon the pattern desired without departing from the principles of the invention. Each of the mantles shown in FIGS. 5, 6 and 7 is closed at one end and has a diverter therein, and provides a different radiation pattern. In the embodiment of FIG. 7, the diverter may be omitted since the closing in of the pipe allows the flame to be diverted and also permits the flame to impinge directly on the honeycomb instead of running parallel to the walls of the structure, and, therefore, higher efficiencies are obtained due to the better heat transfer.

In the embodiment of FIG. 2 a window may be placed over the front of the reflector. If this is so, then the position of the combustor and mantle would be reversed and the air flow would be from left to right. A space must be provided between the window and reflector or holes provided in the reflector to bring air into the reflector.

The devices described may be used in conjunction with means for modulating the output from the sources. For example, a pair of squirrel cage modulators (cylinders with alternate opaque and transparent sections), at least one of which rotates, may be disposed outside the mantle of FIG. 1 to provide modulated radiation over 360° in azimuth. Likewise, a pair of rotating disk modulators also comprised of alternate opaque and transparent sections may be positioned in front of the reflector of FIG. 2 to provide a modulated beam of infrared radiation. Thus, it is to be understood that the embodiments shown are illustrative only and that many variations and modifications may be made without departing from the principles of the invention herein disclosed and defined by the appended claims.

I claim:

1. A combustion heated honeycomb mantle infrared radiation source, comprising:

a combustion heated mantle formed of a material which when heated emits radiant energy, said mantle including walls of a honeycomb structure with the axis of symmetry of the holes of said honeycomb walls being disposed at an angle of less than 180° with respect to the longitudinal axis of said mantle, said mantle being open at one end and closed at the other end;

a diverter disposed at the closed end of said mantle; and means for heating said mantle with combustion gases.

2. Apparatus as recited in claim 1 wherein said combustion heated mantle is open at one end and closed at the other end.

3. Apparatus as recited in claim 2, further including a diverter disposed at the closed end of said mantle.

4. Apparatus as recited in claim 1 wherein said diverter is formed of a honeycomb material with the axis of symmetry of the holes of said honeycomb material being parallel to the longitudinal axis of said mantle.

5. Apparatus as recited in claim 1 wherein said mantle is formed of a material selected from the group consisting of:

silicon carbide;

silicon nitride; and hydrous aluminum silicate.

6. Apparatus as recited in claim 1, further including a reflector for collecting the radiation emitted from said mantle and providing a shaped beam of infrared radiation.

7. Apparatus as recited in claim 6 wherein said mantle is disposed about the focal point of said reflector.

8. Apparatus as recited in claim 7, further including a combustion chamber disposed adjacent said mantle, and means for introducing a combustible mixture into said combustion chamber.

9. Apparatus as recited in claim 8, further including means for exhausting combustion products from said reflector.

10. Apparatus as recited in claim 9, further including a window in front of said reflector.

11. Apparatus as recited in claim 1 wherein said mantle is cylindrically shaped.

12. Apparatus as recited in claim 1 wherein said mantle is rectangularly shaped.

13. Apparatus as recited in claim 1 wherein said mantle is bigger at said open end and smaller at said closed end.

14. Apparatus as recited in claim 1 wherein said angle is 90°.

15. Apparatus as recited in claim 1, further including a protected sheath disposed about said mantle.

16. Apparatus as recited in claim 15 wherein said protective sheath has filtering properties.

* * * * *